US012616325B1

(12) United States Patent
Tan et al.

(10) Patent No.: US 12,616,325 B1
(45) Date of Patent: May 5, 2026

(54) ANTISKID AUTOMOBILE WAREHOUSE MAT WITH TRILATERAL CORNER FIXING MEMBER

(71) Applicant: Zhejiang Zhenya Auto Accessory Co., Ltd., Taizhou City (CN)

(72) Inventors: Zhen Tan, Taizhou City (CN); Chen Cheng, Taizhou City (CN); Wellin Hu, Taizhou City (CN); Fangguo Zhou, Taizhou City (CN)

(73) Assignee: Zhejiang Zhenya Auto Accessory Co., Ltd., Taizhou City (CN)

( * ) Notice: Subject to any disclaimer, the term of this patent is extended or adjusted under 35 U.S.C. 154(b) by 0 days.

(21) Appl. No.: 19/325,185

(22) Filed: Sep. 10, 2025

(30) Foreign Application Priority Data

Jul. 14, 2025 (CN) ..... 202510964212.X
Jul. 29, 2025 (CN) ..... 202511048000.3

(51) Int. Cl.
*A47G 27/02* (2006.01)
*A47G 27/04* (2006.01)

(52) U.S. Cl.
CPC ..... *A47G 27/0281* (2013.01); *A47G 27/0418* (2013.01)

(58) Field of Classification Search
CPC .. A47G 27/0281; A47G 27/0418; B60N 3/04; B60N 3/044; B60N 3/046; B60N 3/048; B60R 13/011; B60R 13/0268; B60P 7/0892
See application file for complete search history.

(56) References Cited

U.S. PATENT DOCUMENTS 999,828 A * 8/1911 McNaughton ..... B60P 7/0892 410/94
4,222,695 A * 9/1980 Sarides ..... B60N 3/046 428/44
4,941,784 A * 7/1990 Flament ..... B60R 7/02 410/121
5,131,709 A * 7/1992 Spica ..... B60R 9/00 411/258
5,549,428 A * 8/1996 Yeatts ..... B60P 7/0892 410/121
5,655,863 A * 8/1997 Mundt ..... B60P 7/0892 410/121

(Continued)

*Primary Examiner* — William L Miller
(74) *Attorney, Agent, or Firm* — Schwegman Lundberg & Woessner, P.A.

(57) ABSTRACT

An antiskid automobile warehouse mat with a trilateral corner fixing member, which includes a warehouse mat body and the trilateral corner fixing member connected to the warehouse mat body. A series of first connecting positioning parts are extended upward from a top surface of the warehouse mat body. The trilateral corner fixing member includes a bottom plate in a shape of an equilateral right triangle and side plates extending upwards at two right-angle sides of the equilateral right triangle. Positioning blocks are extended downwards from three corner points on a bottom surface of the bottom plate, and a second connecting positioning part is provided at a bottom surface of each of the positioning blocks. The trilateral corner fixing member is inserted and fixed to three first connecting positioning parts on the top surface of the warehouse mat body by three second connecting positioning parts on the bottom surface.

18 Claims, 5 Drawing Sheets

(56) References Cited

U.S. PATENT DOCUMENTS 5,788,310 A * 8/1998 McKee ..... B60R 13/01 410/80
5,961,262 A * 10/1999 Weber ..... B60P 7/0892 410/121
6,007,282 A * 12/1999 Mundt ..... B60P 7/0892 410/121
6,012,885 A * 1/2000 Taylor ..... B60P 7/0892 410/121
D429,207 S * 8/2000 Throener ..... D12/223
6,254,162 B1 * 7/2001 Faber ..... B60R 5/04 224/539
6,503,036 B1 * 1/2003 Bequette ..... B60P 7/0815 410/121
6,537,642 B1 * 3/2003 Jacquet ..... A47G 27/0418 52/180
6,578,896 B1 * 6/2003 Peterson ..... B60R 13/011 296/97.23
6,648,569 B2 * 11/2003 Douglass ..... B60P 7/0892 410/46
6,702,532 B1 * 3/2004 Throener ..... B60P 7/0892 410/121
7,527,312 B1 * 5/2009 Cucknell ..... B60R 7/02 296/193.07
9,022,267 B2 * 5/2015 Wisselmann ..... B60R 11/00 224/567
9,248,783 B2 * 2/2016 Thom ..... B60R 7/02
10,583,763 B1 * 3/2020 Schnur ..... B60N 3/046
12,503,031 B2 * 12/2025 Nakayama ..... B60P 3/205
2005/0087530 A1 * 4/2005 Svenson ..... B60R 7/02 220/6
2008/0213537 A1 * 9/2008 Alford ..... B60N 3/046 428/141
2009/0146445 A1 * 6/2009 Bernhardsson ..... B60R 11/00 296/37.14
2009/0243322 A1 * 10/2009 Vance ..... B60N 3/046 296/39.1
2013/0287996 A1 * 10/2013 Masanek, Jr. ..... F16B 2/20 403/338
2014/0354003 A1 * 12/2014 Murray ..... B60R 5/04 296/37.16
2016/0264038 A1 * 9/2016 Parkes ..... F16M 11/22
2017/0036589 A1 * 2/2017 Grochowski ..... B65D 81/056
2018/0093599 A1 * 4/2018 Yang ..... B60N 3/048
2018/0229642 A1 * 8/2018 Kaatz ..... B60P 7/0892
2019/0202334 A1 * 7/2019 Bhirud ..... B60R 7/02
2019/0232859 A1 * 8/2019 Stanesic ..... B60P 7/14
2020/0062158 A1 * 2/2020 Schnur ..... B60N 2/02246
2022/0117427 A1 * 4/2022 Jung ..... A47G 27/0281
2022/0153201 A1 * 5/2022 Reband ..... F16M 11/22
2024/0359638 A1 * 10/2024 Zhang ..... B60R 5/04

* cited by examiner

ANTISKID AUTOMOBILE WAREHOUSE MAT WITH TRILATERAL CORNER FIXING MEMBER

CLAIM FOR PRIORITY

This application claims the benefit of priority of Chinese Application No. 202511048000.3, filed Jul. 29, 2025 and to Chinese Application No. 202510964212.X, filed Jul. 14, 2025, each of which are incorporated herein by reference in their entireties.

TECHNICAL FIELD

The disclosure relates to automobile warehouse mats, in particular to an antiskid automobile warehouse mat with a trilateral corner fixing member.

BACKGROUND ART

As a carrier space, an automobile warehouse needs to be laid with a warehouse mat during use for double protection: on one hand, the warehouse mat can cushion impact on goods due to bumps, and on the other hand, the warehouse mat can avoid the goods from rubbing and scratching a surface of the warehouse. However, existing warehouse mats generally have a problem of poor antiskid performance, and the goods are easy to slide and topple due to inertia during driving of the automobile, which not only affects stability of the goods, but also may cause noise or damage the goods due to collision.

SUMMARY

In view of above problems, the present disclosure aims to provide an antiskid automobile warehouse mat with a trilateral corner fixing member, which is novel in structure, can provide cushioning for goods, can protect a surface of the warehouse from being scratched, and can also fix goods of different sizes to prevent the goods from moving.

A technical scheme of the disclosure is an antiskid automobile warehouse mat with a trilateral corner fixing member characterized by including a warehouse mat body and the trilateral corner fixing member connected to the warehouse mat body. A series of first connecting positioning parts are extended upward from a top surface of the warehouse mat body, and the series of first connecting positioning parts are arranged at equal intervals along a transverse direction to form a plurality of horizontal rows, and a series of first connecting positioning parts are distributed at equal intervals along a longitudinal direction in each of the plurality of horizontal rows. The trilateral corner fixing member includes a bottom plate in a shape of an equilateral right triangle and side plates extending upwards at two right-angle sides of the equilateral right triangle. Three positioning blocks are respectively extended downwards from three corner points on a bottom surface of the bottom plate, and each of the three positioning blocks is provided with a second connecting positioning part. A transverse spacing $d_1$ and a longitudinal spacing $d_2$ between the second connecting positioning parts are respectively equal to a transverse spacing $d_3$ and a longitudinal spacing $d_4$ between adjacent first connecting positioning parts, that is, $d_1$ is equal to $d_3$ and $d_2$ is equal to $d_4$, and the trilateral corner fixing member is inserted and fixed to three first connecting positioning parts on the top surface of the warehouse mat body by three second connecting positioning parts on the bottom surface.

When $d_1$ is equal to $d_2$, the transverse spacing $d_3$ and the longitudinal spacing $d_4$ between adjacent first connecting and positioning parts are also equal to each other, and the trilateral corner fixing member can be applied to different fixing situations only using one model, with better adaptability.

Each of the first connecting positioning parts is a positioning hole, and the second connecting positioning part is a positioning post.

Alternatively, each of the first connecting positioning parts is a positioning post, and the second connecting positioning part is a positioning hole. Both the positioning post and the positioning hole are in a frusto-conical structure with a wider lower portion and a narrower upper portion. When the goods act on the trilateral corner fixing member, a guiding and self-locking structural design is formed between the positioning post and the positioning hole. In addition, such a conical surface generates radial elastic deformation, and the conical surface is pressed more and more tightly under gravity of the goods.

Preferably, the warehouse mat body is longitudinally provided with a plurality of elongated slots at equal intervals, and the positioning post is integrally formed in the plurality of elongated slots, which not only saves materials, but also enhances connection strength between the positioning posts and the body.

Preferably, a top of the positioning post is flush with the top surface of the warehouse mat body in height, so as to ensure that the bottom surface of the bottom plate is closely attached to the top surface of the warehouse mat body after the trilateral corner fixing member is inserted in place, and to prevent the fixing member from shaking.

Preferably, each of the elongated slots has two inclined sides, and a transverse cross section of the elongated slot is in a structure that flares towards an opening of the elongated slot. When the goods act on the warehouse mat body through the trilateral corner fixing member, a larger area at the opening of the slot can directly reduce an average stress at a root of the opening of the slot under a same tension or pressure, which can significantly improves stability of the elongated slot. A raised part adjacent to the elongated groove has an isosceles trapezoid cross section, with a stable structure.

Preferably, a recessed crease groove is transversely provided at a middle of a back of the warehouse mat body, so that the body can be folded along the crease groove, so as to be adapted to depth requirements of different types of warehouses and improves installation flexibility.

Preferably, two wings are symmetrically extended at left and right sides of the warehouse mat body, which can cover a side area of the warehouse. Two positioning mounting holes are further respectively provided at the left and right sides of the warehouse mat body, and an inner wall of each of the positioning mounting holes is provided with two convex teeth oppositely arranged, which are configured to be connected with a preset fixing structure in the warehouse, and the convex teeth are matched with the fixing structure in the warehouse for clamping and limiting, so as to prevent the warehouse mat from self-displacement.

Specifically, there are a plurality of trilateral corner fixing members 2, and the plurality of trilateral corner fixing members 2 are enclosed to form a fixing area adapted to bottoms of goods.

Further, there are four trilateral corner fixing members 2, and side plates of the four trilateral corner fixing members 2 are enclosed to form a square fixing area adapted to the bottoms of the goods. By adjusting their positions on the warehouse mat body, their side plates are enclosed to form the square fixing area adapted to the bottom of the goods, so as to accurately fix four corner points of the goods.

Preferably, there are two side plates, and the two side plates are located on the two right-angle sides of the bottom plate respectively and are matched to each other to form a right-angle limiting structure or an L-shaped blocking structure, so as to limit the goods in an area formed by the bottom plate and the two side plates, provide stable protection and support, and prevent the articles from laterally sliding and toppling.

Further, the two side plates are connected through a curved part of an arc structure to form an integrated structure. The split side plates are with an area with high stress concentration at their right-angle connection, while the curved part of the arc structure can smoothly transfer load and avoid stress concentration. The integrated structure makes the two side plates and the curved part form an integral unit, which enhances ability to resist bending and distortion deformation.

Each of the side plates includes an upper part and a lower part, the lower part is connected with a right-angle side of the bottom plate, and a width of the lower part is greater than a width of the upper part. On one hand, it can be smoothly demoulded and not deformed when the trilateral corner fixing member is molded; and on the other hand, this widened bottom can provide a larger connection area and enhance anti-overturning stability. Preferably, a cross section of the side plate is in an isosceles trapezoid structure, and a lateral force is uniformly transmitted to the bottom plate when the goods act on the side plate, thus prolonging service life.

The side plate includes a first end part and a second end part, and both the first end part and the second end part are not arranged beyond an end point of the right-angle side of the bottom plate. When the end of the side plate extends beyond the bottom plate, an exposed sharp corner can be formed, which is easy to scratch or scrape goods during operation and curl and deform during transportation or collision. Preferably, neither the first end nor the second end extends beyond a center of the second connection positioning part corresponding thereto. In other words, the first end does not extend beyond a center of the second connection positioning part to which it corresponds; and the second end does not extend beyond a center of the second connection positioning part to which it corresponds. The center of the second connecting positioning part refers to a midpoint of a central axis in a length direction of a through hole in the cylindrical positioning hole.

Compared with related art, the disclosure has following advantages.

1. Double skid resistance and stable carrying: the warehouse mat body provides basic skid resistance with material characteristics, and the trilateral corner fixing member limits displacement of the goods through the enclosed structure, and combination of the both can significantly improve antiskid effect.
2. Flexible adaptation and strong versatility: with cooperation of the positioning post and the positioning hole, the position of the fixing member can be freely adjusted so as to be adapted to goods with different sizes and shapes, thus solving a problem of single adaptability of conventional warehouse mats.
3. Reliable structure and convenient installation: a plug-in structure of the fixing member and the body is simple and stable, and it can be quickly assembled and disassembled without tools, and design of the positioning post and the elongated groove enhances overall structural strength.
4. Comprehensive protection and wide adaptability: design of the wings and positioning mounting holes ensures that the warehouse mat itself is firmly installed, and the crease groove can improves the installation flexibility.

Figure 1:
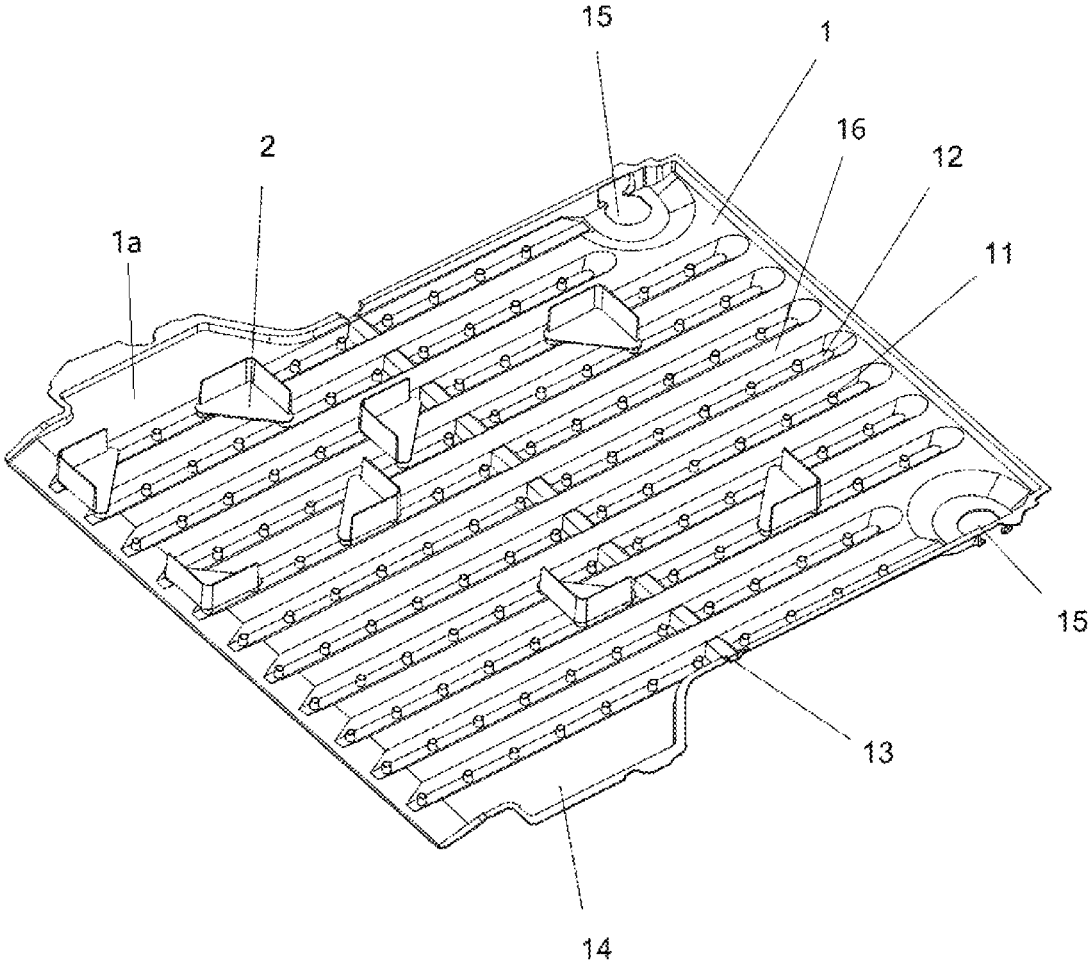
FIG. 1 is a schematic structural view of the present disclosure.

In the figures: 1—Warehouse Mat Body; 1*a*—Top Surface of Warehouse Mat Body; 1*b*—Back of Warehouse Mat Body; 11—First Connection Positioning Part; 12—Elongated Slot; 13—Crease Groove; 14—Wing; 15—Positioning Mounting Hole; 15*a*—Convex Tooth; 16—Raised Part; 2—Trilateral Corner Fixing Member; 21—Bottom Plate; 211—Positioning Block; 212—Second Connection Positioning Part; 22—Side Plate; 21*a*—Right-angle Side; 21*b*—Corner Point; 3—Fixing Area. $d_1$ is a transverse spacing between second connecting positioning parts; $d_2$ is a longitudinal spacing between the second connecting positioning parts; $d_3$ is a transverse spacing between adjacent first connection positioning parts; $d_4$ is a longitudinal spacing between adjacent first connection positioning parts; X direction is a transverse direction; and Y direction is a vertical direction.

DETAILED DESCRIPTION

The present disclosure is further described in detail with reference to drawings.

As shown in FIGS. 1 to 5, an antiskid automobile warehouse mat with a trilateral corner fixing member is provided in an embodiment, which is characterized by including a warehouse mat body 1 and the trilateral corner fixing member 2 connected to the warehouse mat body 1. A series of first connecting positioning parts 11 are extended upward from a top surface of the warehouse mat body 1, and the series of first connecting positioning parts 11 are arranged at equal intervals along a transverse direction to form a plurality of horizontal rows 11*a*, and a series of first connecting positioning parts 11 are distributed at equal intervals along a longitudinal direction in each of the plurality of horizontal rows 11*a*. The trilateral corner fixing member 2 includes a bottom plate 21 in a shape of an equilateral right triangle and side plates 22 extending upwards at two right-angle sides 21*a* of the equilateral right triangle. Three positioning blocks 211 are extended downwards from three corner points 21*b* on a bottom surface of the bottom plate 21, and each of the three positioning blocks 211 is provided with a second connecting positioning part 212. A transverse spacing $d_1$ and a longitudinal spacing $d_2$ between the second connecting positioning parts 212 are respectively equal to a transverse spacing $d_3$ and a longitudinal spacing $d_4$ between adjacent first connecting positioning parts 11, and the trilateral corner fixing member 2 is inserted and fixed to three first connecting positioning parts 11 on the top surface of the warehouse mat body 1 by three second connecting positioning parts 212.

Figure 5:
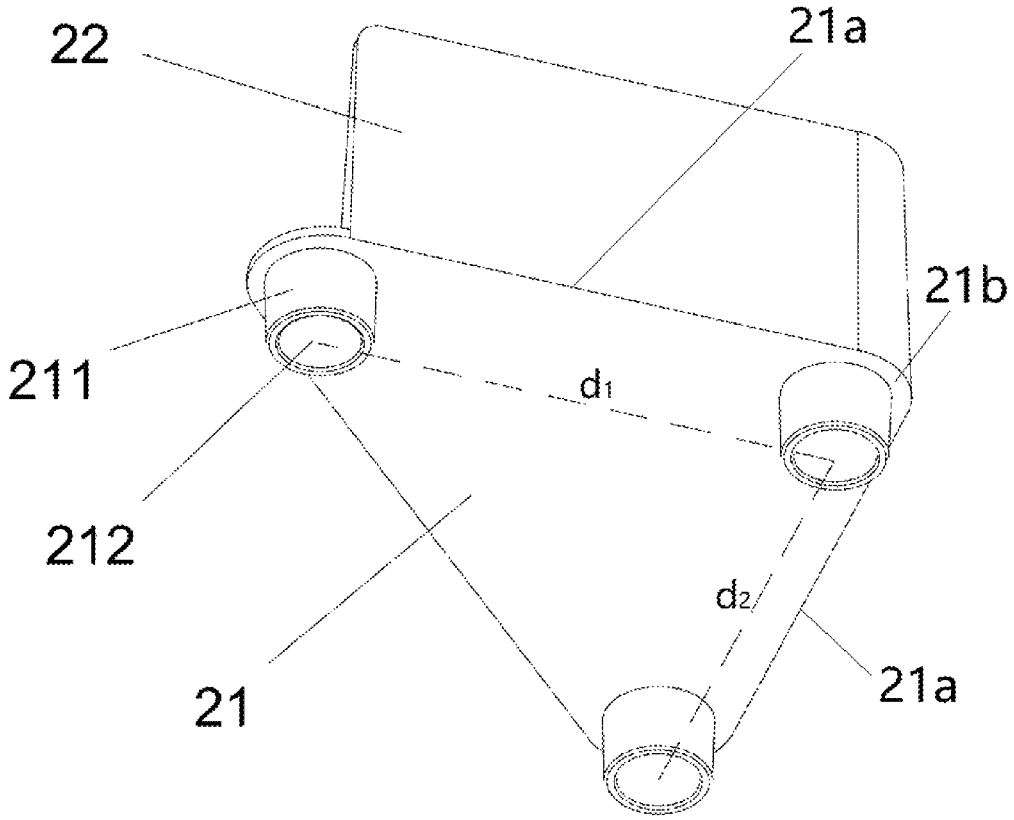
FIG. 5 is a schematic structural view of a trilateral corner fixing member according to the disclosure.

Specifically, referring to FIGS. 1 and 5, the first connecting positioning part 11 is a positioning post and the second connecting positioning part 212 is a positioning hole. The warehouse mat body 1 is longitudinally provided with a plurality of elongated slots 12 at equal intervals, and the positioning post is integrally formed in the elongated slot 12.

Figure 4:
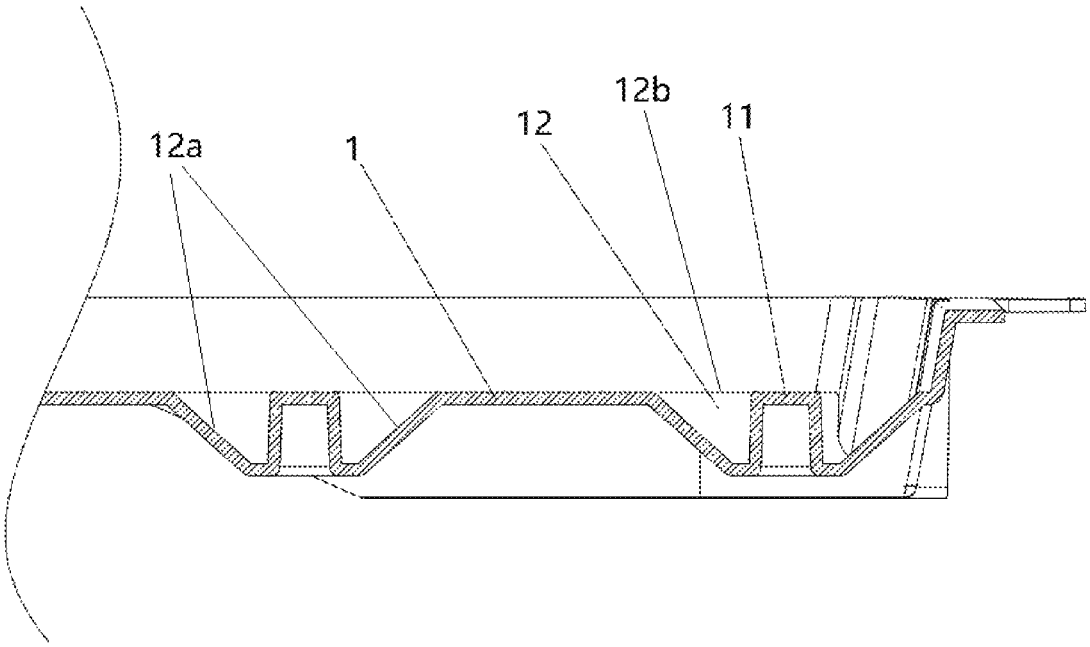
FIG. 4 is a schematic partially structural view of FIG. 3 taken along a direction A-A.

Specifically, referring to FIG. 4, a top of the positioning post is flush with the top surface of the warehouse mat body 1 in height, and the bottom surface of the bottom plate 21 is closely attached to the top surface of the warehouse mat body 1 after the trilateral corner fixing member 2 is inserted in place.

Specifically, referring to FIGS. 1 and 4, each of the elongated slots 12 has two inclined sides 12*a*, and a transverse cross section of the elongated slot 12 is in a structure that flares towards an opening 12*b* of the elongated slot.

Figure 2:
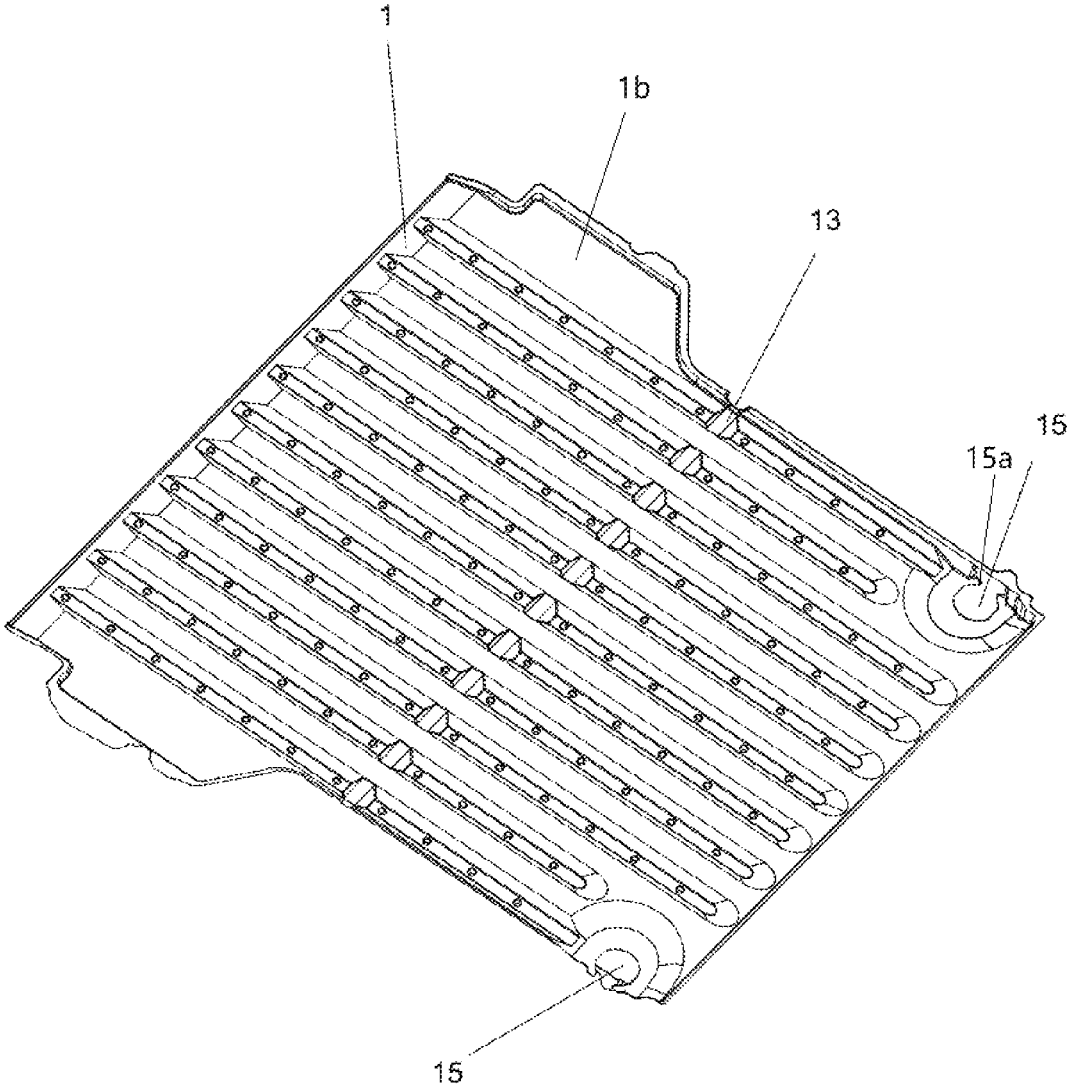
FIG. 2 is a schematic structural view of FIG. 1 from another perspective.
Figure 3:
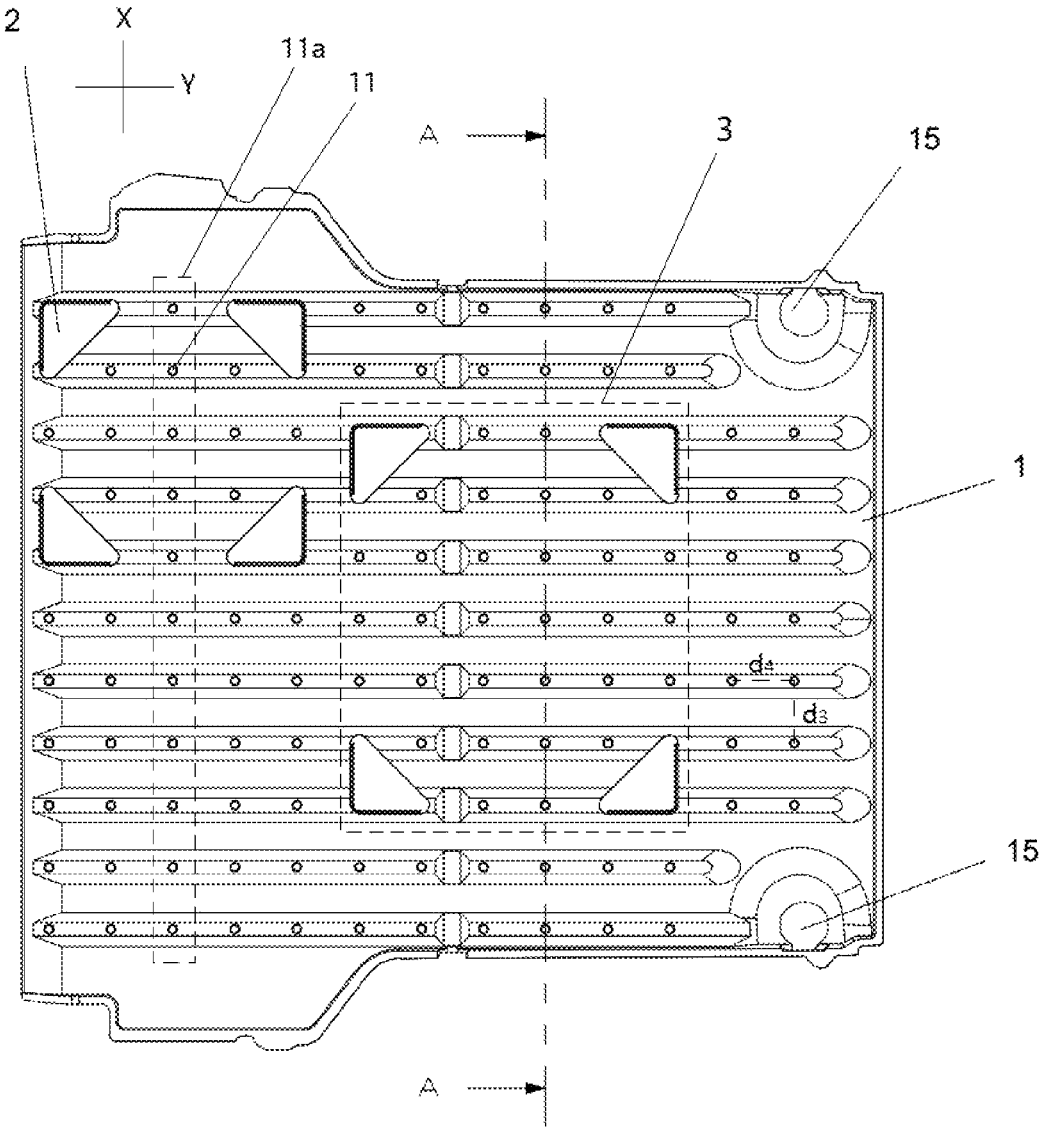
FIG. 3 is a top view of the present disclosure.

Specifically, referring to FIGS. 1 and 2, a recessed crease groove 13 is transversely provided at a middle of a back of the warehouse mat body 1.

Specifically, referring to FIG. 1, two wings 14 are symmetrically extended at left and right sides of a rear of the warehouse mat body 1. Two positioning mounting holes 15 are further respectively provided at the left and right sides of the warehouse mat body 1, and an inner wall of each of the positioning mounting holes 15 is provided with two convex teeth 15*a* oppositely arranged.

Specifically, referring to FIG. 1, there are a plurality of trilateral corner fixing members 2, and the plurality of trilateral corner fixing members 2 are enclosed to form a fixing area 3 adapted to bottoms of goods.

Further, there are four trilateral corner fixing members 2, and side plates of the four trilateral corner fixing members 2 are enclosed to form a square fixing area 3 adapted to the bottoms of the goods.

Figure 6:
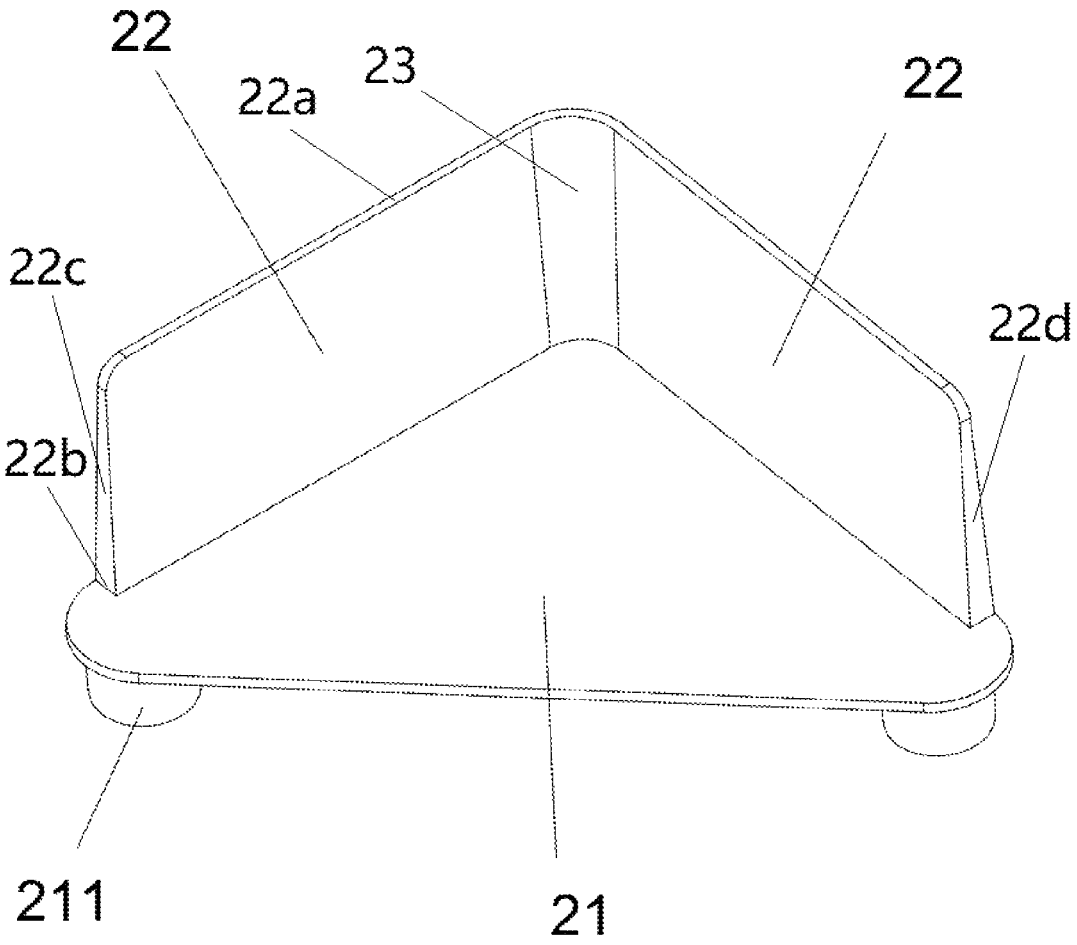
FIG. 6 is another schematic structural view of a trilateral corner fixing member according to the disclosure.

Specifically, referring to FIG. 6, there are two side plates 22, and the two side plates 22 are located on the two right-angle sides of the bottom plate 21 respectively. The two side plates 22 are connected through a curved part 23 of an arc structure to form an integrated structure.

Specifically, referring to FIG. 6, each of the side plates 22 includes an upper part 22*a* and a lower part 22*b*, the lower part is connected with a right-angle side of the bottom plate 21, and a width of the lower part 22*b* is greater than a width of the upper part 22*a*, with a structure with a wider lower portion and a narrower upper portion. More specifically, as shown in FIG. 7, a cross section of the side plate 22 is in an isosceles trapezoid structure.

Figure 7:
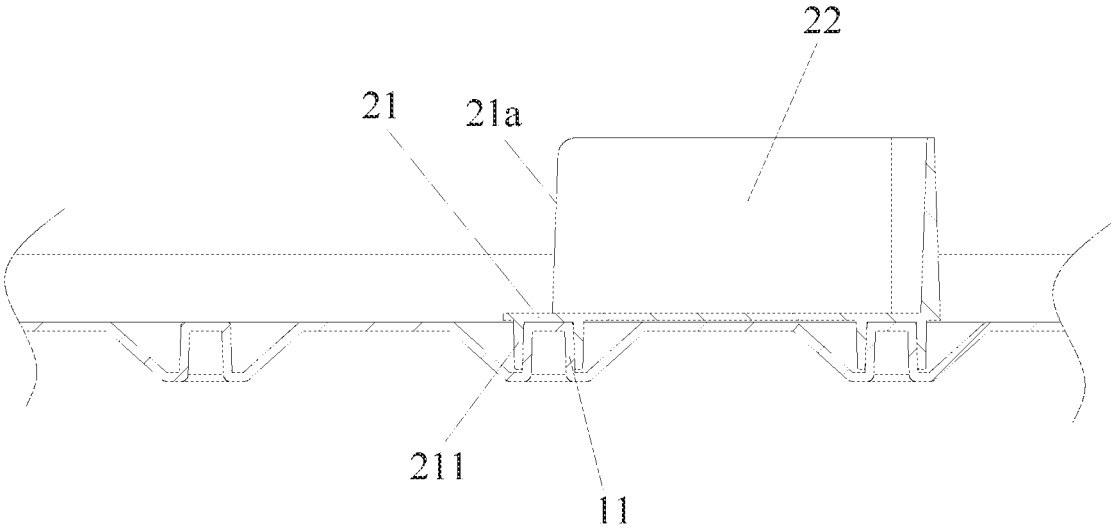
FIG. 7 is a cross-sectional view of a matching structure of a trilateral corner fixing member and a warehouse mat body according to the disclosure.

Specifically, referring to FIGS. 5, 6 and 7, the side plate 22 includes a first end part 22*c* and a second end part 22*d*, and both the first end part 22*c* and the second end part 22*d* are not arranged beyond an end point of the right-angle side of the bottom plate 21. More specifically, neither the first end 22*c* nor the second end 22*d* extends beyond a center of the second connection positioning part 212 corresponding thereto. The center of the second connecting positioning part 212 refers to a midpoint of a central axis in a length direction of a through hole in the cylindrical positioning hole.

In another embodiment, the first connecting positioning part 11 is a positioning hole and the second connecting positioning part 212 is a positioning post, which can also achieve effect that the warehouse mat body 1 and the triangular corner fixing part 2 can be detachably connected with each other and a position of the fixing part can be freely adjusted.

According to sizes of carried goods, a size of the fixing area can be changed as required by inserting the trilateral corner fixing members 2 into three first connecting positioning parts 11 at different positions, and generally, four trilateral corner fixing members 2 can be adopted to enclose a square fixing area. Of course, according to shapes of actual goods, one, two, three, five and six trilateral corner fixing members 2 can also be adopted to enclose the fixing area, with diversified selection modes, a unique and novel overall structure and reliable fixation. Meanwhile, self-weights of the goods are used to increase firmness on the corner fixing member 2.

The disclosure can be used as a car trunk mat, and can also be used as a warehouse mat of a pickup truck.

The above is only the preferred embodiment of the present disclosure, and does not limit the disclosure in any form. Any simple modification, equivalent change or modification of above embodiments according to the technical principle of the present disclosure still falls within a scope of the technical scheme of the present disclosure.

The invention claimed is:

1. An antiskid automobile warehouse mat with a trilateral corner fixing member, comprising a warehouse mat body and the trilateral corner fixing member connected to the warehouse mat body, wherein a series of first connecting positioning parts are extended upward from a top surface of the warehouse mat body, and the series of the first connecting positioning parts are arranged at equal intervals along a transverse direction to form a plurality of horizontal rows, and the series of the first connecting positioning parts are distributed at equal intervals along a longitudinal direction in each of the plurality of horizontal rows; the trilateral corner fixing member comprises a bottom plate in a shape of an equilateral right triangle and side plates extending upwards at two right-angle sides of the equilateral right triangle; three positioning blocks are respectively extended downwards from three corner points on a bottom surface of the bottom plate, and each of the three positioning blocks is provided with a second connecting positioning part; a transverse spacing $d_1$ and a longitudinal spacing $d_2$ between the second connecting positioning parts are respectively equal to a transverse spacing $d_3$ and a longitudinal spacing $d_4$ between adjacent first connecting positioning parts, and the trilateral corner fixing member is inserted and fixed to three of the first connecting positioning parts on the top surface of the warehouse mat body by three of the second connecting positioning parts;

wherein the side plates are connected through a curved part of an arc structure to form an integrated structure.

2. The antiskid automobile warehouse mat with the trilateral corner fixing member according to claim 1, wherein each of the first connecting positioning parts is a positioning hole, and each of the second connecting positioning parts is a positioning post.

3. The antiskid automobile warehouse mat with the trilateral corner fixing member according to claim 1, wherein each of the first connecting positioning parts is a positioning post, and each of the second connecting positioning parts is a positioning hole.

4. The antiskid automobile warehouse mat with the trilateral corner fixing member according to claim 3, wherein the warehouse mat body is longitudinally provided with a plurality of elongated slots at equal intervals, and the positioning post is integrally formed in the plurality of elongated slots.

5. The antiskid automobile warehouse mat with the trilateral corner fixing member according to claim 4, wherein each of the elongated slots has two inclined sides, and a transverse cross section of the elongated slot flares towards an opening of the elongated slot.

6. The antiskid automobile warehouse mat with the trilateral corner fixing member according to claim 3, wherein a top of the positioning post is flush with the top surface of the warehouse mat body in height, so as to ensure that the bottom surface of the bottom plate is closely attached to the top surface of the warehouse mat body after the trilateral corner fixing member is inserted in place.

7. The antiskid automobile warehouse mat with the trilateral corner fixing member according to claim 1, wherein a recessed crease groove is transversely provided at a middle of a back of the warehouse mat body.

8. The antiskid automobile warehouse mat with the trilateral corner fixing member according to claim 1, wherein two wings are symmetrically extended at left and right sides of the warehouse mat body.

9. The antiskid automobile warehouse mat with the trilateral corner fixing member according to claim 1, wherein two positioning mounting holes are further respectively provided at left and right sides of the warehouse mat body, and an inner wall of each of the positioning mounting holes is provided with two convex teeth oppositely arranged.

10. The antiskid automobile warehouse mat with the trilateral corner fixing member according to claim 1, wherein there are a plurality of the trilateral corner fixing members, and the plurality of the trilateral corner fixing members are arranged to form a fixing area adapted to bottoms of goods.

11. The antiskid automobile warehouse mat with the trilateral corner fixing member according to claim 10, wherein there are four of the trilateral corner fixing members, and the side plates of the four trilateral corner fixing members are arranged to form a square fixing area adapted to the bottoms of the goods.

12. The antiskid automobile warehouse mat with the trilateral corner fixing member according to claim 1, wherein each of the side plates comprises an upper part and a lower part, the lower part is connected with a right-angle side of the bottom plate, and a width of the lower part is greater than a width of the upper part.

13. The antiskid automobile warehouse mat with the trilateral corner fixing member according to claim 12, wherein a cross section of the side plate is in an isosceles trapezoid structure.

14. The antiskid automobile warehouse mat with the trilateral corner fixing member according to claim 1, wherein each of the side plates comprise a first end part and a second end part, and both the first end part and the second end part are not arranged beyond an end point of a right-angle side of the bottom plate.

15. The antiskid automobile warehouse mat with the trilateral corner fixing member according to claim 14, wherein neither the first end nor the second end extends beyond a center of the second connection positioning part corresponding thereto.

16. An antiskid automobile warehouse mat with a trilateral corner fixing member, comprising a warehouse mat body and the trilateral corner fixing member connected to the warehouse mat body, wherein a series of first connecting positioning parts are extended upward from a top surface of the warehouse mat body, and the series of the first connecting positioning parts are arranged at equal intervals along a transverse direction to form a plurality of horizontal rows, and the series of the first connecting positioning parts are distributed at equal intervals along a longitudinal direction in each of the plurality of horizontal rows; the trilateral corner fixing member comprises a bottom plate in a shape of an equilateral right triangle and side plates extending upwards at two right-angle sides of the equilateral right triangle; three positioning blocks are respectively extended downwards from three corner points on a bottom surface of the bottom plate, and each of the three positioning blocks is provided with a second connecting positioning part; a transverse spacing $d_1$ and a longitudinal spacing $d_2$ between the second connecting positioning parts are respectively equal to a transverse spacing $d_3$ and a longitudinal spacing $d_4$ between adjacent first connecting positioning parts, and the trilateral corner fixing member is inserted and fixed to three of the first connecting positioning parts on the top surface of the warehouse mat body by three of the second connecting positioning parts;

wherein each of the first connecting positioning parts is a positioning post, and each of the second connecting positioning parts is a positioning hole;

wherein the warehouse mat body is longitudinally provided with a plurality of elongated slots at equal intervals, and the positioning post is integrally formed in the plurality of elongated slots.

17. The antiskid automobile warehouse mat with the trilateral corner fixing member according to claim 16, wherein the side plates are connected through a curved part of an are structure to form an integrated structure.

18. An antiskid automobile warehouse mat with a trilateral corner fixing member, comprising a warehouse mat body and the trilateral corner fixing member connected to the warehouse mat body, wherein a series of first connecting positioning parts are extended upward from a top surface of the warehouse mat body, and the series of the first connecting positioning parts are arranged at equal intervals along a transverse direction to form a plurality of horizontal rows, and the series of the first connecting positioning parts are distributed at equal intervals along a longitudinal direction in each of the plurality of horizontal rows; the trilateral corner fixing member comprises a bottom plate in a shape of an equilateral right triangle and side plates extending upwards at two right-angle sides of the equilateral right triangle; three positioning blocks are respectively extended downwards from three corner points on a bottom surface of the bottom plate, and each of the three positioning blocks is provided with a second connecting positioning part; a transverse spacing $d_1$ and a longitudinal spacing $d_2$ between the second connecting positioning parts are respectively equal to a transverse spacing $d_3$ and a longitudinal spacing $d_4$ between adjacent first connecting positioning parts, and the trilateral corner fixing member is inserted and fixed to three of the first connecting positioning parts on the top surface of the warehouse mat body by three of the second connecting positioning parts;

wherein each of the side plates comprises an upper part and a lower part, the lower part is connected with a right-angle side of the bottom plate, and a width of the lower part is greater than a width of the upper part.

* * * * *